US007542706B2

(12) United States Patent
Yamada et al.

(10) Patent No.: US 7,542,706 B2
(45) Date of Patent: Jun. 2, 2009

(54) IMAGE FORMING APPARATUS, IMAGE FORMING METHOD AND IMAGE FORMING PROGRAM

(75) Inventors: Ayako Yamada, Yokohama (JP); Tetsuro Sakai, Fukaya (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 260 days.

(21) Appl. No.: 11/366,322

(22) Filed: Mar. 1, 2006

(65) Prior Publication Data

US 2007/0206978 A1 Sep. 6, 2007

(51) Int. Cl.
*G03G 15/01* (2006.01)

(52) U.S. Cl. ..... 399/301

(58) Field of Classification Search ..... 399/301
See application file for complete search history.

(56) References Cited

U.S. PATENT DOCUMENTS

2004/0239746 A1* 12/2004 Ozawa et al. ..... 347/116
2005/0238372 A1* 10/2005 Shinohara et al. ..... 399/44

FOREIGN PATENT DOCUMENTS

JP 8-278680 4/1995
JP 2003295560 A * 10/2003

* cited by examiner

*Primary Examiner*—David M Gray
*Assistant Examiner*—Bryan Ready
(74) *Attorney, Agent, or Firm*—SoCal IP Law Group LLP; Steven C. Sereboff; John E. Gunther

(57) ABSTRACT

An image forming apparatus concurrently conducts alignment of toner images of respective color components on a transfer belt and alignment control of the toner images. In the image forming apparatus of this invention, when a region occupied by a composite toner image that is to be superposed on a transfer unit belt is ensured even excluding a region occupied by a test pattern, and when a predetermined condition to conduct alignment control is met (S505), an alignment control unit executes alignment control concurrently with ordinary composite toner image generation (S506, S507, S508, S503). Thus, the amount of time spent just for alignment control is reduced.

12 Claims, 5 Drawing Sheets

IMAGE FORMING APPARATUS, IMAGE FORMING METHOD AND IMAGE FORMING PROGRAM

BACKGROUND OF THE INVENTION

1. Field of the Invention

The present invention relates to an image forming apparatus that forms toner images on a sheet, and in particular relates to color shift correction technology that corrects shifts in the transfer position of a toner image from its regular position.

2. Description of the Related Art

In conventional image forming apparatus that include a multicolor printing function, photoconductor drums are disposed in four image generating units that are disposed in tandem, for example, and electrostatic latent images of the color components of yellow, magenta, cyan and black are generated on the photoconductor drums. In this case, a fixed scanning head or the like is used to generate the electrostatic latent images of the respective color components on the photoconductor drums on the basis of data of the respective color components, the electrostatic latent images are developed to generate toner images of the respective color components, and the toner images are sequentially superposed on a transfer belt. The superposed toner images (hereinafter called a composite toner image) are then transferred to printing paper that is conveyed. In this case, whether or not the positions of the toner images of the respective color components to be superposed on the transfer belt have shifted from their regular positions is checked. If there are positional shifts, control is conducted to reduce the positional shifts of the toner images because color shift will be generated. This correction control is done, for example, by changing the exposure timing in the main scanning direction and the sub-scanning direction in accordance with the detected shifts when image data is supplied from a memory to the fixed scanning head.

Technologies that have been proposed for the purpose of eliminating such shift are disclosed in (1) JP-A-8-278680 (regarding a color shift eliminating method), (2) JP-A-8-101555 (regarding a method of preventing the detection of a test pattern from becoming unable to be precisely conducted due to fluctuation in the output of a registration sensor resulting from the transfer belt), and (3) JP-A-8-258340 (regarding the prevention of color shift when the toner images are superposed).

The basic portions of the aforementioned technologies will be briefly described with reference to FIGS. 3 and 4. In this image forming apparatus, a registration sensor 81L at the front side of a transfer belt 90 and a registration sensor 81R at the rear side of the transfer belt 90 are disposed at the downstream side of the transfer belt as shown in FIG. 3 with a predetermined gap G between them in the main scanning direction (direction perpendicular to the moving direction of the transfer belt) of the toner images to be transferred. The registration sensors 81L and 81R read test patterns 80L and 80R (see FIG. 4) generated in order to detect the aforementioned shifts, detect the extent to which the positions of the test patterns have shifted from their regular positions (reference positions), and conduct control to reduce the shifts. In this example, when there are no shifts, as shown in FIG. 3 and the magnified view of FIG. 4, the test patterns 80L and 80R transferred to the transfer belt 90 are configured by first and third linear portions that are perpendicular to the moving direction of the transfer belt 90 and by second and fourth linear portions that intersect the first and third linear portions at a 45° angle.

In this case, the test patterns generated by the image generating units that generate the toner images of the color components of black, cyan, magenta and yellow (indicated by the subscript letters K, C, M and Y in FIG. 3) are transferred onto the transfer belt as shown in FIG. 3. Thus, the timing at which the first and third linear portions and the second and fourth linear portions cross the registration sensors 81L and 81R is detected, and the moving speed of the transfer belt 90 is referenced to calculate distances LTK, RTK, LVK and RVK relating to the color component of black.

Distances LTC, RTC, . . . , RTY relating to the color components of cyan, magenta and yellow are calculated in the same manner. Thus, using for example the first and third linear portions of black as references, distances a and a', b and b', and c and c' to the first and third linear portions of the respective color components are calculated. In the case of FIG. 3, it will be understood that the generation of the yellow image is slanted by an angle θY with respect to the transfer belt 90 because the distance c and the distance c' are different. Correction of the positional shift of this image (for details on the correction, see aforementioned (1) JP-A-8-278680) becomes implementable, and alignment of the toner images of the respective color components can be precisely conducted.

The aforementioned alignment control relating to the toner images is configured by a former-half process, such as generating the test patterns and acquiring the data resulting from the test patterns, and by a latter-half process for correcting the positional shifts of the images on the basis of processing of the acquired data and conducting printing where the shifts are eliminated. These processes are shown in FIG. 5 together with their required times. That is, step SA, which is a preparatory step for stabilizing the operation of the laser, requires about 43 seconds. Step SB, which is for printing the test patterns and acquiring data obtained as a result of the test patterns being read by the registration sensors in the alignment control, requires about 13.52 seconds. Step SC, which is for correcting printing based on the data acquired in step SB, requires about 6 seconds. Step SD, which is for checking the quality of alignment after correction, requires 8.48 seconds although it is similarly included in the correction. Step SE, which is processing following the end of step SD, requires about 6 seconds.

As described above, in conventional image forming apparatus, test patterns corresponding to the respective color components are generated in the image generating units that generate toner images of the color components of black, cyan, magenta and yellow. The generated test patterns are read by the registration sensors, and processing of programmed alignment control is conducted, whereby the positions of the toner images to be superposed and transferred can be precisely matched. Thus, color shifts in the composite toner image can be eliminated.

However, the aforementioned alignment control of the toner images is conducted when the power of the image forming apparatus is turned ON or when the warm-up of the image forming apparatus ends, or is executed when it is detected during printing that printing has reached a predetermined number of sheets and printing is temporarily stopped. This execution requires an amount of time of 1 minute or more when the aforementioned amounts of time and other amounts of time are considered. Consequently, there is the problem that efficiency is made worse because the amount of time during which printing cannot be conducted is increased in either case.

SUMMARY OF THE INVENTION

The present invention has been made in order to solve the aforementioned problem, and it is an object thereof to provide an image forming apparatus that enables ordinary image printing and alignment control to be concurrently conducted, and which can therefore reduce the amount of time spent just for alignment control.

In order to solve the aforementioned problem, an image forming apparatus pertaining to the present invention forms a toner image of a predetermined pattern at a predetermined position on a transfer surface of a transfer body, on which a toner image to be transferred to a sheet is to be formed, and corrects, on the basis of the timing at which the pattern is detected by a sensor, the position where the toner image is formed on the transfer surface, the image forming apparatus comprising: a region determining unit that determines, on the basis of image data serving as the target of image formation, whether or not a region of the toner image to be formed on the transfer surface on the basis of the image data will be superposed on the predetermined position on the transfer surface; a pattern forming unit that causes the predetermined pattern to be formed on the transfer surface concurrently with image formation processing based on the image data when it has been determined by the region determining unit that the region of the toner image to be formed on the transfer surface will not be superposed on the predetermined position on the transfer surface; a detecting unit that detects the predetermined pattern that is formed on the transfer surface and moves integrally with the transfer surface; and a correction processing unit that corrects, on the basis of the timing at which the detecting unit detects the predetermined pattern, the position where the toner image is formed on the transfer surface.

Further, an image forming method pertaining to the invention forms a toner image of a predetermined pattern at a predetermined position on a transfer surface of a transfer body, on which a toner image to be transferred to a sheet is to be formed, and corrects, on the basis of the timing at which the pattern is detected by a sensor, the position where the toner image is formed on the transfer surface, the image forming method comprising: a region determining step that determines, on the basis of image data serving as the target of image formation, whether or not a region of the toner image to be formed on the transfer surface on the basis of the image data will be superposed on the predetermined position on the transfer surface; a pattern forming step that causes the predetermined pattern to be formed on the transfer surface concurrently with image formation processing based on the image data when it has been determined by the region determining step that the region of the toner image to be formed on the transfer surface will not be superposed on the predetermined position on the transfer surface; a detecting step that detects the predetermined pattern that is formed on the transfer surface and moves integrally with the transfer surface; and a correction processing step that corrects, on the basis of the timing at which the detecting step detects the predetermined pattern, the position where the toner image is formed on the transfer surface.

Further, an image forming program pertaining to the invention causes a computer to form a toner image of a predetermined pattern at a predetermined position on a transfer surface of a transfer body, on which a toner image to be transferred to a sheet is to be formed, and to correct, on the basis of the timing at which the pattern is detected by a sensor, the position where the toner image is formed on the transfer surface, the image forming program causing the computer to execute: a region determining step that determines, on the basis of image data serving as the target of image formation, whether or not a region of the toner image to be formed on the transfer surface on the basis of the image data will be superposed on the predetermined position on the transfer surface; a pattern forming step that causes the predetermined pattern to be formed on the transfer surface concurrently with image formation processing based on the image data when it has been determined by the region determining step that the region of the toner image to be formed on the transfer surface will not be superposed on the predetermined position on the transfer surface; a detecting step that detects the predetermined pattern that is formed on the transfer surface and moves integrally with the transfer surface; and a correction processing step that corrects, on the basis of the timing at which the detecting step detects the predetermined pattern, the position where the toner image is formed on the transfer surface.

DESCRIPTION OF THE EMBODIMENTS

An embodiment of the present invention will be described below with reference to the drawings.

Figure 1:
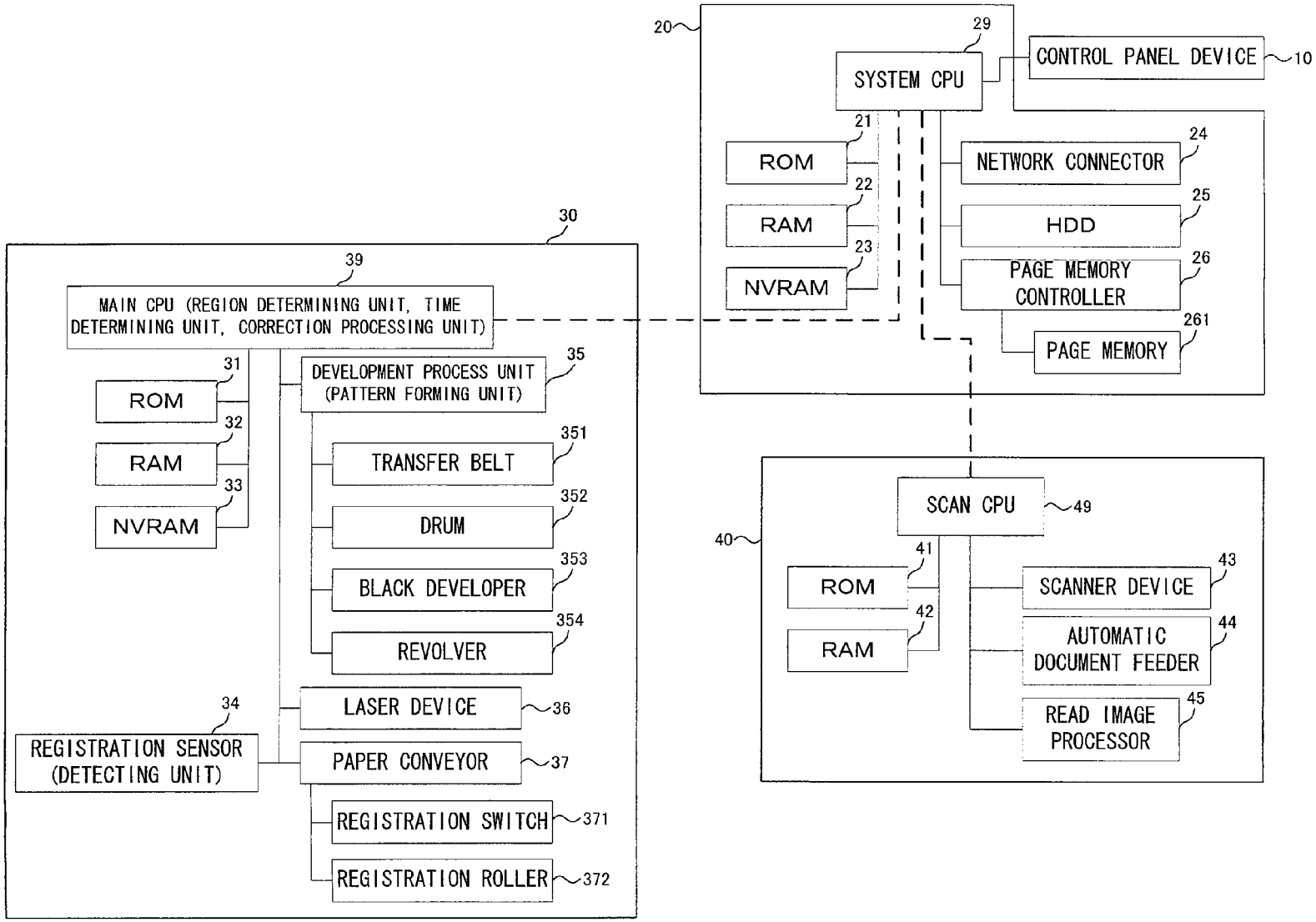
FIG. 1 is a block diagram showing an embodiment of an image forming apparatus of this invention.
Figure 2:
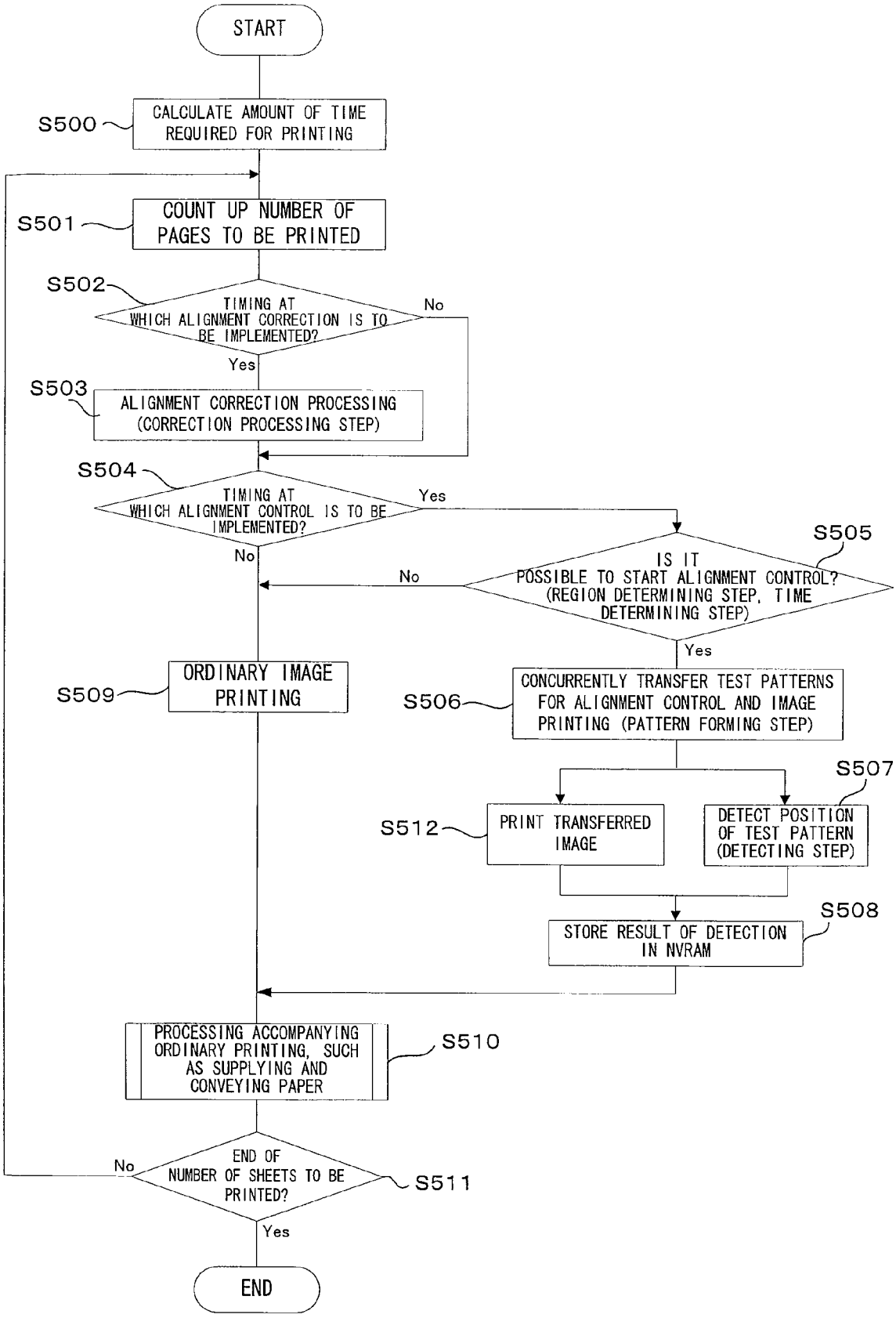
FIG. 2 is a flow chart for describing the content of control that is executed by the image forming apparatus shown in FIG. 1.

FIG. 1 is a block diagram showing an embodiment of an image forming apparatus of this invention, and FIG. 2 is a flow chart for describing the content of control that is executed by the image forming apparatus shown in FIG. 1. The "image alignment control" referred to here is configured by a former-half process, such as generating a test pattern and acquiring data obtained by as a result of the test pattern being read by a registration sensor, and by a latter-half process for correcting positional shifts with respect to the generation of toner images of the images on the basis of the result of processing the acquired data and for conducting image printing where there are no positional shifts.

The image forming apparatus shown in FIG. 1 generates a toner image of a predetermined pattern at a predetermined position on a transfer surface of a transfer body, on which a toner image to be transferred to a sheet is to be formed, and corrects, on the basis of the timing at which the pattern is detected by a sensor, the position where the toner image is formed on the transfer surface. The image forming apparatus is configured by a panel device 10, a system unit 20, an engine unit 30, and a scanner unit 40. The system unit 20 includes a ROM 21, a RAM 22, a NVRAM 23, a network connector 24, an HDD 25, a page memory controller 26 disposed with a page memory 261, and a system CPU (corresponding to a region determining unit, a time determining unit and a correction processing unit) 29. The engine unit 30 includes a ROM 31, a RAM 32, a NVRAM 33, a registration sensor (corresponding to a detecting unit) 34, a development process unit 35 disposed with a transfer belt (corresponding to a transfer body) 351, a drum 352, a black developer 353 and a revolver 354, a laser device 36, a paper conveyor 37 disposed with a registration switch 371 and a registration roller 372, and a main CPU 39. In this example, the engine unit 30 anchored by the CPU 39 works as an alignment control unit. The scanner unit 40 includes a ROM 41, a RAM 42, a scanner device 43, an automatic document feeder 44, a read image processor 45, and a scan CPU 49.

In the aforementioned case, the system CPU 29 grasps status information sent from the main CPU 39 and the scan CPU 49 and input information from the control panel device 10, and uses the units 21 to 26 to control the entire image forming apparatus. The main CPU 39 controls the development process unit (corresponding to a pattern forming unit) 35, the laser device 36, and the paper conveyor 37 to conduct image formation, and conducts image alignment control based on the data of the test pattern read by the registration sensor 34.

The scan CPU 49 drives the disposed devices such as the scanner device 43 and the automatic document feeder 44 to conduct processing relating to image reading. It will be noted that programs relating to the control of each unit are stored in the ROMs 21, 31 and 41 in the units 20, 30 and 40, that the RAMs 22, 32 and 42 are used to execute those programs and the like, and that the NVRAMs 23 and 33 are nonvolatile RAMs that store information and the like unique to each unit.

The system CPU 29 determines, on the basis of image data serving as the target of image formation, whether or not a region of a toner image to be formed on the transfer surface on the basis of the image data will be superposed on a predetermined position on the transfer surface.

The development process unit 35 causes a predetermined pattern to be formed on the transfer surface concurrently with image formation processing based on the image data when it has been determined by the system CPU 29 that the region of the toner image to be formed on the transfer surface will not be superposed on the predetermined position on the transfer surface.

The registration sensor 34 detects the predetermined pattern that is formed on the transfer surface and moves integrally with the transfer surface.

Further, the system CPU 29 corrects, on the basis of the timing at which the registration sensor 34 detects the predetermined pattern, the position where the toner image is formed on the transfer surface. Further, the system CPU 29 determines whether or not the region of the toner image to be formed on the transfer surface on the basis of the image data will be superposed on the predetermined position on the transfer surface when the angle of the toner image to be formed on the transfer surface on the basis of the image data has been rotated.

The development process unit 35 conducts image formation processing in a state where the angle of the toner image to be formed on the transfer surface on the basis of the image data has been rotated such that it becomes an angle where the toner image is not superposed on the predetermined position on the transfer surface, and causes the predetermined pattern to be formed on the transfer surface.

Further, the system CPU 29 includes the function of determining which of an amount of time required to form an image on the sheet based on the image data serving as the target of image formation and an amount of time required for the development process unit 35 to form the predetermined pattern is longer.

The development process unit 35 causes the predetermined pattern to be formed on the transfer surface when it has been determined by the system CPU 29 that the region of the toner image to be formed on the transfer surface will not be superposed on the predetermined position on the transfer surface and when it has been determined that the amount of time required for the development process unit 35 to form the predetermined pattern is shorter than the amount of time required to form an image on the sheet based on the image data serving as the target of image formation.

The system CPU 29 determines which of an amount of time required for image formation processing based on continuous plural image data serving as the target of image formation and an amount of time required for the development process unit 35 to form the predetermined pattern is longer.

The system CPU 29 determines whether or not the region of the toner image to be formed on the transfer surface will be superposed on the predetermined position on the transfer surface when the number of sheets of image formation conducted after the development process unit 35 previously executed formation processing of the predetermined pattern has reached a predetermined threshold.

Next, the flow of the processing (image forming method) in the image forming apparatus according to the present embodiment will be described.

An example will be described, with reference to FIG. 2, where ordinary printing executed by the aforementioned units and image alignment control when a certain condition is met are concurrently processed. When the image forming apparatus begins printing, the main CPU 39 of the engine unit 30 reads from the ROM 31 the amount of time required to print one sheet in accordance with the designated mode (reduce, enlarge, rotate, etc.) and calculates the amount of time required to print all of the sheets in the current print job (S500). The result of the calculation is used to determine in step S505 whether or not alignment control (generation and transfer of test pattern, and acquisition of the data obtained by reading the test pattern) is executable. Next, the number of sheets of paper to be printed is counted up (incremented) (S501). The result of the counting-up is used in the determination of step S511.

After the number of sheets to be printed is counted up, it is determined whether the timing is a timing at which alignment correction is to be implemented (S502). That is, data for alignment is already prepared in the NVRAM 33 in the processing of steps S506 to S508 and the like, and it is determined whether or not alignment correction is possible. If the timing is a timing at which alignment correction is to be implemented, then the position where the toner image is formed on the transfer surface is corrected (correction processing step) (S503) on the basis of the timing at which the predetermined pattern is detected in the detection step, and thereafter the processing moves to step S504. Further, in step S502, if no data has been prepared and the timing is not a timing at which alignment correction is to be implemented, then alignment correction is not conducted and the processing moves to step S504.

In step S504, after previous image alignment correction has been executed, it is determined whether or not printing of a preset number of sheets has been newly done, i.e., whether or not the timing is a timing at which alignment control including printing a test pattern is to be implemented. When it is determined that the timing is not a timing at which alignment control is to be implemented, ordinary printing is conducted (S509), and processing accompanying printing, such as supplying and conveying paper, is conducted (S510). If step S510 has been completed, then it is determined from the result of the counting-up in step S501 whether or not the number of sheets to be printed has reached the end number (S511). If the number of sheets to be printed has reached the end number, then the processing ends, and if the number of sheets to be printed has not reached the end number, then the processing returns to step S501.

In step S504, when it has been determined that the timing is a timing at which alignment control is to be implemented, the main CPU 39 determines whether or not it is possible to start alignment control including the generation of a test pattern (region determining step, time determining step) (S505). Specifically, the main CPU 39 determines, on the basis of image data serving as the target of image formation, whether or not the region of the toner image to be formed on the transfer surface on the basis of the image data will be superposed on the predetermined position on the transfer surface, and determines which of the amount of time required to form an image on the sheet based on the image data serving as the target of image formation and the amount of time required for the pattern forming step to form the predetermined pattern is longer.

Figure 3:
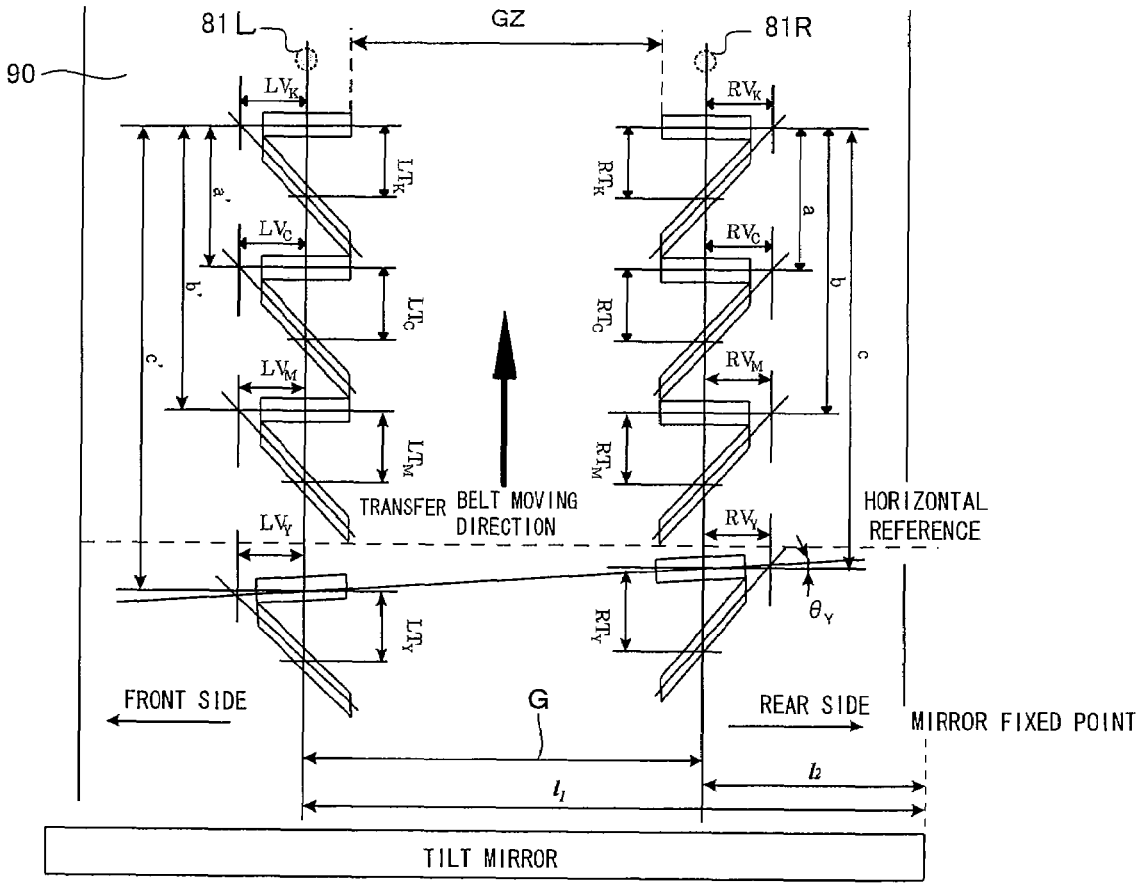
FIG. 3 is a diagram for describing the relationship between a transfer belt and test patterns in a conventional image forming apparatus.
Figure 4:
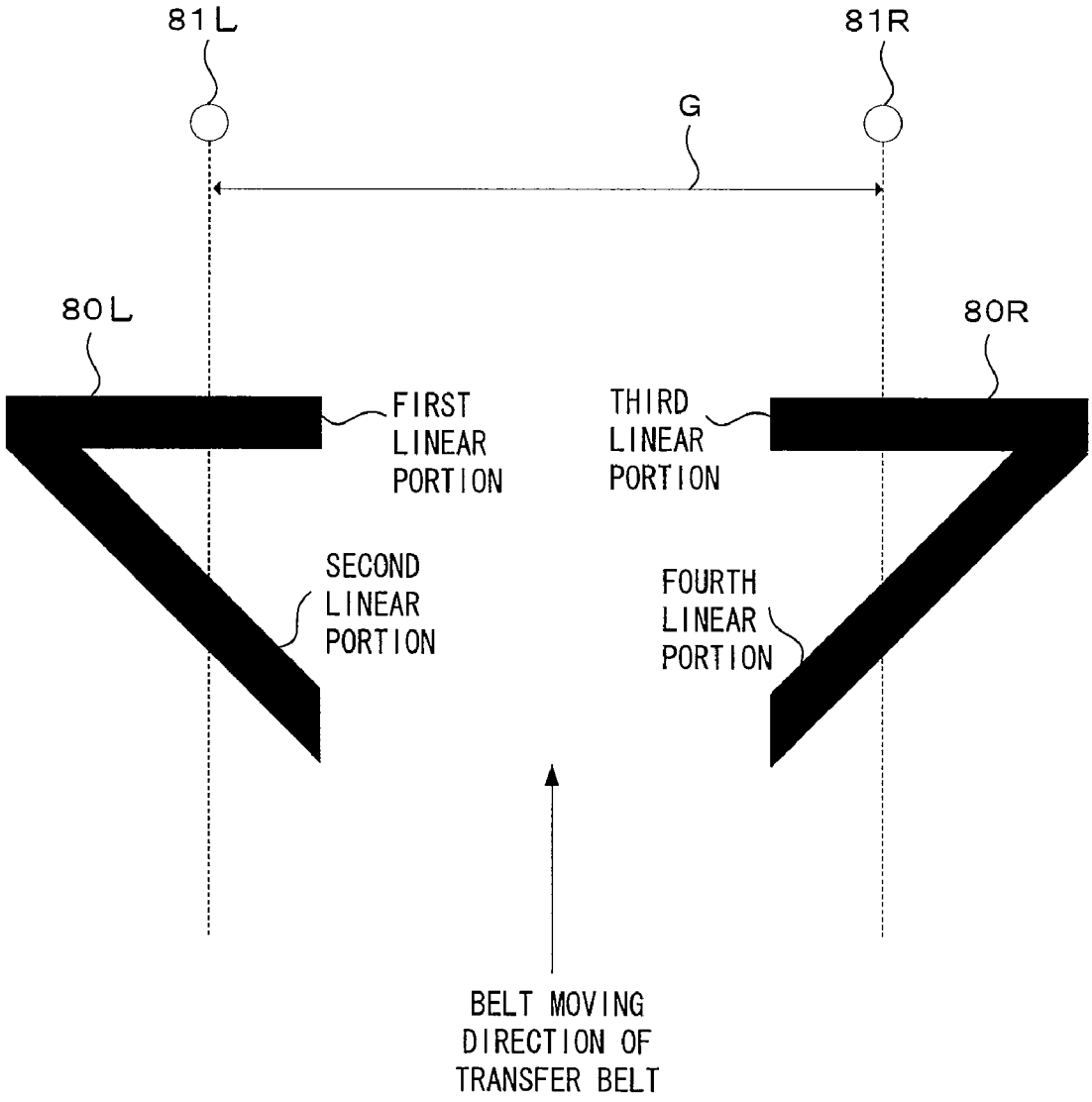
FIG. 4 is a magnified view for describing the test patterns shown in FIG. 3.
Figure 5:
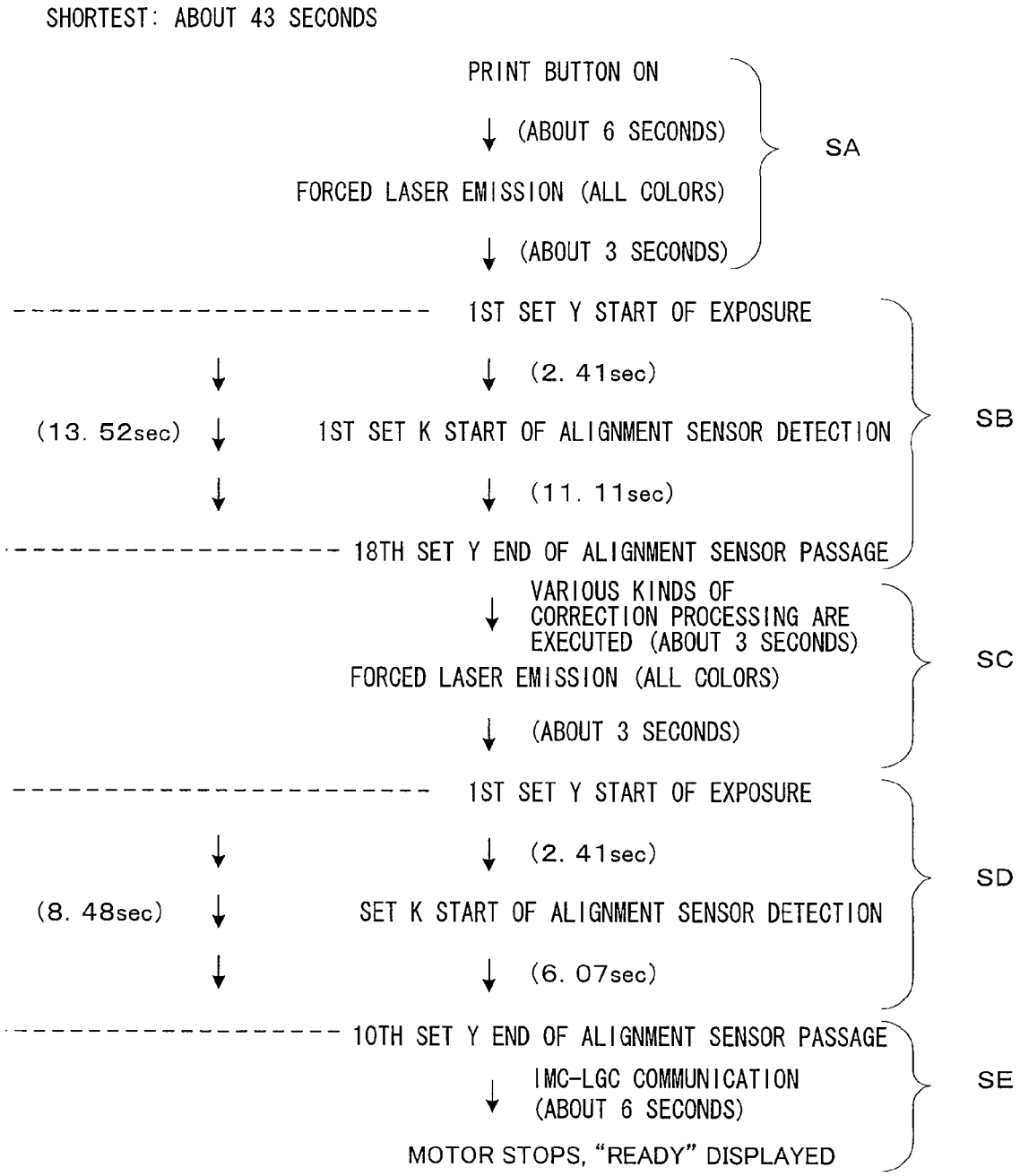
FIG. 5 is a diagram for describing alignment control and the elapse of time in the conventional image forming apparatus.

For example, the main CPU 39 determines if the amount of time calculated in step S500 is equal to or greater than a set threshold, or determines whether or not a condition, including whether a region GZ (see FIG. 3) where a toner image is to be transferred when a test pattern has been printed on the transfer belt sufficiently remains, is met. In step S505, when it has been determined that it is not possible to start alignment control, then alignment control is not started and the processing moves to step S509, where ordinary printing is conducted.

However, in step S505, when it has been determined that it is possible to start alignment control, then a test pattern for alignment control and an image for printing are concurrently transferred onto the transfer surface (pattern forming step) (S506). That is, in the pattern forming step, a predetermined pattern is formed on the transfer surface when it has been determined by the region determining step that the region of the toner image to be formed on the transfer surface will not be superposed on the predetermined position on the transfer surface and when it has been determined that the amount of time required for the pattern forming step to form a predetermined pattern is shorter than the amount of time required to form an image on the sheet based on the image data serving as the target of image formation.

As the alignment control, first, printing of the test pattern is started, and the registration sensor 34 sequentially detects the test patterns (predetermined patterns) that are transferred and conveyed (detecting step) (S507). Further, concurrently with the detecting step, the toner image for printing that has been transferred onto the transfer surface in the pattern forming step is transferred to the sheet, and printing is conducted (S512).

Next, the data detected in the aforementioned detecting step is stored in the NVRAM 33, and the processing moves to step 510 (S508). Depending on the setting, in step S508, together with storing the data, it is also preferable to calculate correction data for step S503 based on the detected data and to store the result of the calculation in the NVRAM 33. In another setting, the calculation of correction data may also be conducted in step S503 or the like.

As described above, according to the image forming apparatus of this invention, the printing onto a transfer belt of a test pattern and the acquisition of data obtained as a result of the test pattern being read by a registration sensor used in image alignment control can be implemented concurrently with ordinary image printing as in steps S506 to S508. Consequently, there are fewer times when the ordinary printing process is stopped just to conduct image alignment control, and the efficiency of a print job can be improved.

Various responses, such as those described below, are conceivable depending on differences in conditions other than that described above.

(1) Although this relates to a continuous print job such as previous input, in a case where printing has ended first when alignment control is being conducted during printing of small-size paper, printing ends but alignment control continues and is completed.

(2) A test pattern for alignment control is transferred onto the transfer belt as much as possible during printing of small-size paper, reading of the test pattern by the registration sensor is executed, and the read data is stored when printing of the paper ends. Then, when the next small-size paper is printed, the residual test pattern is transferred onto the transfer belt, and reading of the test pattern by the registration sensor is completed.

(3) The amount of time required for printing of small-size paper is calculated when printing starts, and image printing and alignment control are concurrently implemented only when that amount of time is equal to or greater than the amount of time required for alignment control. In this case, jobs where small-size paper whose printing ends in a short amount of time is to be printed are searched for from previously inputted jobs. When the searched jobs continue, the amount of time required to print those jobs is calculated, and if alignment control can be done within the calculated amount of time, then image printing and alignment control are concurrently implemented.

(4) In the case of (3), when print jobs of small-size paper that can be done in a short amount of time do not continue, then the job order is changed and print jobs of small-size paper are joined together. Thus, if the amount of time for the joined print jobs is longer than the amount of time for alignment control, then image printing and alignment control are concurrently implemented. That is, in the time determining step, it is determined which of the amount of time required for image formation processing based on continuous plural image data serving as the target of image formation and the amount of time required for the pattern forming step to form the predetermined pattern is longer.

Image rotation is conducted in a case where image printing and alignment control can be concurrently executed by rotating the image 90° when the size of the image to be printed cannot be executed concurrently with alignment control. Further, image reduction is conducted in a case where image reduction is allowed and image printing and alignment control can be concurrently executed by reducing the image. In this manner, in the region determining step, when the angle of the toner image to be formed on the transfer surface on the basis of image data has been rotated, it also becomes possible to determine whether or not the region of the toner image to be formed on the transfer surface on the basis of the image data will be superposed on the predetermined position on the transfer surface. The pattern forming step conducts image formation processing in a state where the angle of the toner image to be formed on the transfer surface on the basis of the image data has been rotated such that it becomes an angle where the toner image is not superposed on the predetermined position on the transfer surface, and causes the predetermined pattern to be formed on the transfer surface.

Each of the steps in the processing of the aforementioned image forming method is realized by causing at least either of the system CPU 29 and the main CPU 39 to execute an image forming program stored in at least any of the ROMs 21 to 41, the RAMs 22 to 42, and the HDD 25.

In the present embodiment, description has been given in a case where the function of implementing the invention was prerecorded inside the apparatus, but the invention is not limited to this. The same function may also be downloaded to the apparatus from a network, or a program where the same function has been stored in a recording medium may be installed in the apparatus. The recording medium may be any format as long as it is one in which the program can be stored and which can be read by the apparatus, such as a CD-ROM. It may also be one that causes a function obtained by pre-installing or downloading in this manner to work together with the OS (operating system) inside the apparatus.

The present invention has been described in detail by way of a specific embodiment, but it will be apparent to those skilled in the art that various changes and modifications can be made as long as they do not depart from the spirit and scope of the invention.

As described in detail above, according to the present invention, when a region occupied by a composite toner image that is to be superposed on a transfer unit belt is ensured even excluding a region occupied by a test pattern, and when a predetermined condition to conduct alignment control is met, an alignment control unit executes alignment control concurrently with ordinary toner image generation. Consequently, the amount of time spent just for alignment control is reduced.

What is claimed is:

1. An image forming apparatus that forms a toner image of a predetermined pattern at both edge regions of a moving direction on a transfer surface of a transfer body, on which a toner image to be transferred to a sheet is to be formed, and corrects, on the basis of the timing at which the pattern is detected by a sensor, the position where the toner image is formed on the transfer surface, the image forming apparatus comprising:

a region determining unit that determines, on the basis of image data serving as the target of image formation, whether or not a region of the toner image to be formed on the transfer surface on the basis of the image data will be superposed on the edge;

a pattern forming unit that forms the image data and the predetermined pattern simultaneously on the transfer surface when it has been determined by the region determining unit that the region of the toner image to be formed on the transfer surface will not be superposed on the edge regions;

a detecting unit that detects the predetermined pattern that is formed on the transfer surface and moves integrally with the transfer surface;

a correction processing unit that corrects, on the basis of the timing at which the detecting unit detects the predetermined pattern, the position where the toner image is formed on the transfer surface, and a time determining unit that determines which of an amount of time required to form an image on the sheet based on the image data serving as the target of image formation and an amount of time required for the pattern forming unit to form the predetermined pattern is longer, wherein the pattern forming unit causes the predetermined pattern to be formed on the transfer surface when it has been determined by the region determining unit that the region of the toner image to be formed on the transfer surface will not be superposed on the edge regions on the transfer surface and when it has been determined that the amount of time required for the pattern forming unit to form the predetermined pattern is shorter than the amount of time required to form an image on the sheet based on the image data serving as the target of image formation.

2. The image forming apparatus of claim 1, wherein the region determining unit determines whether or not the region of the toner image to be formed on the transfer surface on the basis of the image data will be superposed on the edge regions when the angle of the toner image to be formed on the transfer surface on the basis of the image data has been rotated, and the pattern forming unit conducts image formation processing in a state where the angle of the toner image to be formed on the transfer surface on the basis of the image data has been rotated such that it becomes an angle where the toner image is not superposed on the edge regions on the transfer surface, and causes the predetermined pattern to be formed on the transfer surface.

3. The image forming apparatus of claim 1, wherein the time determining unit determines which of an amount of time required for image formation processing based on continuous plural image data serving as the target of image formation and an amount of time required for the pattern forming unit to form the predetermined pattern is longer.

4. The image forming apparatus of claim 1, wherein the region determining unit determines whether or not the region of the toner image to be formed on the transfer surface will be superposed on the edge regions on the transfer surface when the number of sheets of image formation conducted after the pattern forming unit previously executed formation processing of the predetermined pattern has reached a predetermined threshold.

5. An image forming method that forms a toner image of a predetermined pattern at both edge regions of a moving direction on a transfer surface of a transfer body, on which a toner image to be transferred to a sheet is to be formed, and corrects, on the basis of the timing at which the pattern is detected by a sensor, the position where the toner image is formed on the transfer surface, the image forming method comprising:

a region determining step that determines, on the basis of image data serving as the target of image formation, whether or not a region of the toner image to be formed on the transfer surface on the basis of the image data will be superposed on the edge regions;

a pattern forming step that forms the image data and the predetermined pattern simultaneously on the transfer surface when it has been determined by the region determining step that the region of the toner image to be formed on the transfer surface will not be superposed on the edge regions;

a detecting step that detects the predetermined pattern that is formed on the transfer surface and moves integrally with the transfer surface;

a correction processing step that corrects, on the basis of the timing at which the detecting step detects the predetermined pattern, the position where the toner image is formed on the transfer surface, and a time determining step that determines which of an amount of time required to form an image on the sheet based on the image data serving as the target of image formation and an amount of time required for the pattern forming step to form the predetermined pattern is longer, wherein the pattern forming step causes the predetermined pattern to be formed on the transfer surface when it has been determined by the region determining step that the region of the toner image to be formed on the transfer surface will not be superposed on the edge regions on the transfer surface and when it has been determined that the amount of time required for the pattern forming step to form the predetermined pattern is shorter than the amount of time required to form an image on the sheet based on the image data serving as the target of image formation.

6. The image forming method of claim 5, wherein the region determining step determines whether or not the region of the toner image to be formed on the transfer surface on the basis of the image data will be superposed on the edge regions when the angle of the toner image to be formed on the transfer surface on the basis of the image data has been rotated, and the pattern forming step conducts image formation processing in a state where the angle of the toner image to be formed on the transfer surface on the basis of the image data has been rotated such that it becomes an angle where the toner image is not superposed on the edge regions on the transfer surface, and causes the predetermined pattern to be formed on the transfer surface.

7. The image forming method of claim 5, wherein the time determining step determines which of an amount of time required for image formation processing based on continuous plural image data serving as the target of image formation and an amount of time required for the pattern forming step to form the predetermined pattern is longer.

8. The image forming method of claim 5, wherein the region determining step determines whether or not the region of the toner image to be formed on the transfer surf ace will be superposed on the edge regions on the transfer surface when the number of sheets of image formation conducted after the pattern forming step previously executed formation processing of the predetermined pattern has reached a predetermined threshold.

9. A computer-readable storage media storing instructions which, when executed, cause a computer to perform actions including forming a toner image of a predetermined pattern at both edge regions of a moving direction on a transfer surface of a transfer body, on which a toner image to be transferred to a sheet is to be formed, and correcting, on the basis of the timing at which the pattern is detected by a sensor, the position where the toner image is formed on the transfer surface, the actions performed further comprising:

a region determining step that determines, on the basis of image data serving as the target of image formation, whether or not a region of the toner image to be formed on the transfer surface on the basis of the image data will be superposed on the edge regions;

a pattern forming step that forms the image data and the predetermined pattern simultaneously when it has been determined by the region determining step that the region of the toner image to be formed on the transfer surface will not be superposed on the edge regions on the transfer surface;

a detecting step that detects the predetermined pattern that is formed on the transfer surface and moves integrally with the transfer surface;

a correction processing step that corrects, on the basis of the timing at which the detecting step detects the predetermined pattern, the position where the toner image is formed on the transfer surface, and a time determining step that determines which of an amount of time required to form an image on the sheet based on the image data serving as the target of image formation and an amount of time required for the pattern forming step to form the predetermined pattern is longer, wherein the pattern forming step causes the predetermined pattern to be formed on the transfer surface when it has been determined by the region determining step that the region of the toner image to be formed on the transfer surface will not be superposed on the edge regions on the transfer surface and when it has been determined that the amount of time required for the pattern forming step to form the predetermined pattern is shorter than the amount of time required to form an image on the sheet based on the image data serving as the target of image formation.

10. The computer-readable storage media of claim 9, wherein the region determining step determines whether or not the region of the toner image to be formed on the transfer surface on the basis of the image data will be superposed on the edge regions when the angle of the toner image to be formed on the transfer surface on the basis of the image data has been rotated, and the pattern forming step conducts image formation processing in a state where the angle of the toner image to be formed on the transfer surface on the basis of the image data has been rotated such that it becomes an angle where the toner image is not superposed on the edge regions on the transfer surface, and causes the predetermined pattern to be formed on the transfer surface.

11. The computer-readable storage media of claim 9, wherein the time determining step determines which of an amount of time required for image formation processing based on continuous plural image data serving as the target of image formation and an amount of time required for the pattern forming step to form the predetermined pattern is longer.

12. The computer-readable storage media of claim 9, wherein the region determining step determines whether or not the region of the toner image to be formed on the transfer surface will be superposed on the edge regions on the transfer surface when the number of sheets of image formation conducted after the pattern forming step previously executed formation processing of the predetermined pattern has reached a predetermined threshold.

* * * * *